US008042466B2

(12) United States Patent
Bechtler et al.

(10) Patent No.: US 8,042,466 B2
(45) Date of Patent: Oct. 25, 2011

(54) PRINTING PRESS WITH ADJUSTABLE BEARER RINGS

(75) Inventors: Jochen Bechtler, Malsch (DE); Michael Krüger, Edingen-Neckarhausen (DE); Detlef Strunk, Heidelberg (DE); Willi Stutz, Neustadt (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 905 days.

(21) Appl. No.: 12/041,107

(22) Filed: Mar. 3, 2008

(65) Prior Publication Data

US 2008/0210110 A1 Sep. 4, 2008

(30) Foreign Application Priority Data

Mar. 2, 2007 (DE) ..... 10 2007 010 231

(51) Int. Cl.
*B41F 13/12* (2006.01)

(52) U.S. Cl. ..... 101/248; 101/142; 101/217; 101/481; 101/486

(58) Field of Classification Search ..... 101/248
See application file for complete search history.

(56) References Cited

U.S. PATENT DOCUMENTS

| | | | | |
|---|---|---|---|---|
| 1,338,347 | A * | 4/1920 | Wood | 101/216 |
| 2,724,331 | A * | 11/1955 | Schmidt | 101/216 |
| 3,732,814 | A * | 5/1973 | Pasquinelli | 101/247 |
| 4,072,104 | A | 2/1978 | Schaffer | |
| 4,759,287 | A * | 7/1988 | Shizuya | 101/248 |
| 4,953,461 | A | 9/1990 | Gaffney et al. | |
| 6,293,194 | B1 | 9/2001 | Vrotacoe | |

FOREIGN PATENT DOCUMENTS

| | | |
|---|---|---|
| CH | 232 102 | 5/1944 |
| DE | 24 36 199 A1 | 2/1975 |
| DE | 195 01 243 C5 | 1/2004 |
| EP | 0 342 573 A2 | 11/1989 |
| EP | 0 353 652 B1 | 9/1994 |
| EP | 0 806 294 A2 | 11/1997 |

OTHER PUBLICATIONS

Search Report of the German Patent and Trademark Office.

* cited by examiner

*Primary Examiner* — Jill Culler

(74) *Attorney, Agent, or Firm* — Laurence A. Greenberg; Werner H. Stemer; Ralph E. Locher

(57) ABSTRACT

A printing press and a method for controlling a printing press include rotatably mounted cylinders. At least two adjacent cylinders roll on one another through bearer rings. At least one of the adjacent cylinders can be rotated actively relative to at least one of the bearer rings by a setting device.

14 Claims, 3 Drawing Sheets

PRINTING PRESS WITH ADJUSTABLE BEARER RINGS

CROSS-REFERENCE TO RELATED APPLICATION

This application claims the priority, under 35 U.S.C. §119, of German Patent Application DE 10 2007 010 231.5, filed Mar. 2, 2007; the prior application is herewith incorporated by reference in its entirety.

BACKGROUND OF THE INVENTION

1. Field of the Invention

The present invention relates to a printing press having rotatably mounted cylinders. At least two adjacent cylinders roll on one another through bearer rings (Schmitz rings). The present invention also relates to a method of controlling a printing press.

In rotary printing presses it is known for adjacent cylinders in a printing unit to have bearer rings firmly connected to a cylinder, in order to avoid effects of channel impacts, which impair the printing quality. Blanket and plate cylinders rolling on one another have bearer rings at the sides for that purpose, which are pressed against one another during printing operation and thus roll on one another. That prevents the pressure from being increased as the channel in the blanket cylinder or plate cylinder passes through and prevents what are known as channel impacts from occurring, which lead to oscillations and therefore to a worsening of the printing quality. In addition, German Patent DE 195 01 243 C5 discloses the use of bearer rings which are not firmly connected to the associated cylinder. For that purpose, the cylinder of a rotary printing press has journals on which a rotatable bearer ring is mounted. In that way, it is not possible for any undesired transmission of torques to arise through bearer rings connected to one another by a force-locking connection. The intention is to prevent influences on the printed image as a result of avoiding the transmission of a torque. However, there are situations during printing operation in which such an influence on the printed image is desired. Such an influence, however, is possible neither in the case of a firmly mounted bearer ring nor in the case of a rotatably mounted bearer ring through which no torque can be transmitted.

BRIEF SUMMARY OF THE INVENTION

It is accordingly an object of the invention to provide a printing press with adjustable bearer rings and a method of controlling a printing press, which overcome the hereinaforementioned disadvantages of the heretofore-known devices and methods of this general type and in which a printed image can be influenced through the use of a cylinder involved in the printing.

With the foregoing and other objects in view there is provided, in accordance with the invention, a printing press, comprising bearer rings, rotatably mounted cylinders including at least two adjacent cylinders rolling on one another through the bearer rings, and a setting device for actively rotating at least one of the adjacent cylinders relative to at least one of the bearer rings.

According to the present invention, the cylinder is rotatably mounted with respect to the associated bearer rings. In addition, however, a setting device is provided which makes it possible to rotate the cylinder actively with respect to the associated bearer rings. Through the use of this active setting device, the cylinder can be influenced in accordance with the stipulations of the operating personnel of the printing press. The setting device can be an electric motor, a hydraulic drive or a pneumatic drive. Combinations of setting devices, such as an electrohydraulic setting device, are also possible. Any desired rotational movements of the cylinder with respect to the bearer rings can be carried out as a result of the employment of an active setting device. In this way, printed image corrections in the circumferential direction of the cylinder can be executed if the cylinder is the plate cylinder. In this way, machine-induced, reproducible printing defects can be avoided during the printing operation through the use of the setting device, as a result of an action which counteracts the printing defects in real time. Such a correction in the circumferential direction is designated a printing length correction and can also be used for the purpose of counteracting paper growth or paper shortening due to influences such as ink, water, temperature and atmospheric humidity without any mechanical change to the printing plate being necessary. As compared with the previously known correction of printing length defects through the use of underlays on the blanket cylinder or of end compression or stretching of the printing plate through the use of adjusting screws, the present invention offers the advantage that the correction can also be carried out during the printing operation. However, in the case of the conventional methods, the correction can be performed only when at a standstill. In the case of the conventional methods, it is only possible to monitor if the correction was successful during subsequent printing so that, if appropriate, a plurality of correction operations have to be carried out when at a standstill.

In accordance with another feature of the invention, the mechanical coupling of the cylinders by gear wheels in the printing unit of a printing press can be maintained, which is not possible in the case of a pure direct drive through the use of cylinders continuously driven independently. Despite the actively adjustable cylinder, in the case of the present invention the high rigidity of a conventional printing unit with cylinders connected through a gear train is ensured. In this way, adjacent cylinders such as plate cylinders, blanket cylinders and impression cylinders in the printing unit can be coupled rigidly mechanically to one another as previously and it is nevertheless possible, for example, to rotate the plate cylinder with respect to its bearer rings through the active setting device and in this way to carry out any desired printing length correction even during printing operation. In this case, the adjacent cylinders are coupled to one another mechanically, in particular through gear mechanisms or gear wheels, and the cylinder provided with rotatable bearer rings can be rotated actively with respect to the mechanical coupling of the gear train or of the gear mechanism. The adjacent cylinders coupled through gear wheels or gear mechanisms can also be coupled mechanically to the cylinders of other printing units through further gear wheels, so that all of the cylinders of the printing press can be driven through a gear train and by one motor. It is also possible for there to be partial gear trains, which are then in each case driven by a motor. Thus a plurality of printing units can be combined into groups.

In accordance with a further feature of the invention, it is possible for the cylinder to be rotated actively with respect to at least one bearer ring through the use of a phase adjustment mechanism. Mechanical isolation between the cylinder and the associated bearer rings is possible by using such a phase adjustment mechanism. In this case, the gear mechanism is used as a coupling element and is preferably implemented as a high step-down ratio gear mechanism which is extremely torsionally stiff. In this way, the connection between the bearer ring and the cylinder represents a quasi rigid connection, through which the drive power, for example from the gear train, is transmitted to the cylinder. Provision is advantageously made for the phase adjustment mechanism to be an epicyclic gear mechanism. In this case, for example through a sun wheel of an epicyclic gear mechanism, the cylinder can be adjusted actively with respect to the bearer rings and therefore also with respect to the gear train of the printing press coupled to the bearer rings. As a result of the high step-down ratio of the epicyclic gear mechanism, it is possible to use a servo motor having a relatively low output. In this embodiment, provision is made for the servo motor to be disposed within the cylinder and thus to adjust the epicyclic gear mechanism.

In principle it is possible for only the bearer ring on one side of a cylinder to be actively rotatable, while the bearer ring on the other side of the cylinder is loosely rotatably mounted, for example as in the prior art. Preferably, however, both of the bearer rings of the associated cylinder are constructed to be actively rotatable on both sides, so that both of the bearer rings are connected to the cylinder through epicyclic gear mechanisms. In this case, both of the epicyclic gear mechanisms must be constructed to be adjustable through the use of a servo motor. To this end, each of the epicyclic gear mechanisms can have an individual servo motor, with the two servo motors then being coupled electrically to each other. Alternatively, it is also possible to use only one servo motor, which adjusts the two epicyclic gear mechanisms simultaneously through a mechanical shaft. In this embodiment, the electric energy of the servo motor and the control signals for the motor must be transmitted into the cylinder of the printing press. This can be done, for example, through a rotary transformer, which transmits electric energy and control signals inductively. Radio transmission of at least the control signals is also possible. The servo motors only need to work when the cylinder is adjusted with respect to the bearer rings. If the bearer rings and cylinders are to rotate synchronously, the servo motors do not have to rotate. Due to the high step-up ratio of the epicyclic gear mechanism, they then have to apply only a small force so that the parts of the epicyclic gear mechanism do not rotate with respect to one another.

In accordance with an added feature of the invention, the phase adjustment mechanism functions on the principle of a harmonic drive mechanism. Harmonic drive mechanisms likewise have a high step-up ratio. An input and an output shaft of the harmonic drive mechanism can be rotated with respect to each other through the use of an adjusting motor. This mechanism is also very torsionally stiff and thus likewise constitutes a quasi rigid connection between the cylinder and the associating bearer rings. As a result of the fact that the harmonic drive mechanism includes only a few components, it is relatively simple in this case to carry out an implementation for actuating the harmonic drive mechanism in the interior of the cylinder, so that the setting motor for actuating the harmonic drive mechanism does not necessarily have to be accommodated in the interior of the cylinder. Instead, the adjusting motor can be fixedly mounted outside the cylinder in the external region of the side wall of the printing press. In the case of this refinement, however, it is necessary to take into account the fact that the drive shaft which effects the adjustment of the cylinder must always rotate synchronously at the rotational speed of the cylinder. This means that the adjusting motor must be configured in such a way that synchronization with the rotational speed of the cylinder is ensured. The adjustment of the cylinder with respect to the bearer rings is then achieved by superimposing an angle-dependent rotational speed. In this case, it is also sufficient to use a servo motor with a relatively low output but a high rotational speed, which represents a considerable advantage as compared with the direct drive of the cylinder, since in this case an appropriately large electric motor must be provided.

In accordance with an additional feature of the invention, the at least one adjusting drive is connected to an electronic control device and the electronic control device contains previously stored control curves for the actuation of the adjusting drive or calculates them. The control curves are obtained in such a way that, in the movement profile, the average rotational speeds, matched to the printing operation and the rolling of the cylinders on one another and to the channel, of the bearer rings, cylinder and cylinder drive are identical over one revolution. The electronic control device in principle monitors all of the drive motors of the printing press and in this way ensures the printing operation. If a desired length correction is to be performed through the adjusting drive of the cylinder, this correction must be converted into an appropriate rotational movement of the cylinder with respect to the bearer rings and the cylinder drive. This can be done through control curves, which are stored in the electronic control device and are transmitted to an adjusting drive as characteristic curves as a function of the respectively set printing speed. However, since the printing speed can in principle vary over a wide range and flexible setting of the printing length change is also to be possible, one preferred embodiment provides for the control curves to be calculated as a function of the respectively selected printing length correction and the set printing speed. In this refinement of the invention, the optimal control curve for the actuation of the adjusting drive can be stored for each printing length correction and the printing speed currently set, so that flexible driving of the adjusting drive is possible.

With the objects of the invention in view, there is also provided a method for controlling a printing press. The method comprises providing a gear train of the printing press, providing at least one cylinder connected to other cylinders of the printing press through the gear train, actively rotating the at least one cylinder relative to the gear train with a drive, and during printing operation, carrying out movement control of the at least one cylinder connected to the gear train independently of other cylinders of the printing press, with an electronic drive system of the drive.

Through the use of this method, any desired change to the printing lengths is possible during printing operation, so that desired corrections to the printed image can be made during printing operation. This method also functions in the case of printing units in which cylinders are not coupled to one another through bearer rings. Despite this, it is also in principle possible in this case to profit from the highly accurate mechanical coupling of the gear train. In this case, in addition to the device using rotatable bearer rings already mentioned, the mobility of the cylinder can also be achieved through the use of a drive motor which is disposed in the interior of the cylinder and is thus able to set the cylinder rotating with respect to the gear train as desired. This means that the drive gear wheel of the cylinder is not rigidly connected but that the drive gear wheel of the cylinder is connected to the cylinder through a drive. If the drive motor is not driven, the cylinder can additionally be fixed with respect to the drive gear wheel of the gear train through the use of a pawl element, so that the cylinder and the gear train are then rigidly connected to each other. If this locking is canceled, however, by driving the electric motor, the cylinder can also be rotated with respect to the gear train as desired during printing operation.

In accordance with another mode of the invention, the adjustable cylinder is the plate cylinder and, through the use of an electronic drive system of the electric drive, it is possible for patterns to be applied superimposed on a printing material. In addition to the printing length correction in order to avoid defects in the printed image, the adjustable plate cylinder can thus also be used for the purpose of changing the printed image. To this end, the electronic drive system performs appropriate superimposition of drive signals, so that the desired patterns can be applied to the printing material. Through the use of an appropriate algorithm in the electronic drive system, it is thus possible to perform coding and encryption in the circumferential direction in order, for example, to secure printing materials against forgery. In this case, first of all an analysis of the respective subject provided for the print can be carried out, with an algorithm then calculating the appropriate control commands in the electronic drive system for the electric drive by using the desired coding.

In accordance with a concomitant mode of the invention, the drive effects circumferential register adjustment. Through the use of the drive, it is thus additionally possible for a remotely adjustable 360 degree circumferential register to be implemented. This means that the otherwise usual register adjustment can be dispensed with and the circumferential register adjustment can be carried out on its own through the use of the drive.

Other features which are considered as characteristic for the invention are set forth in the appended claims.

Although the invention is illustrated and described herein as embodied in a printing press with adjustable bearer rings and a method of controlling a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
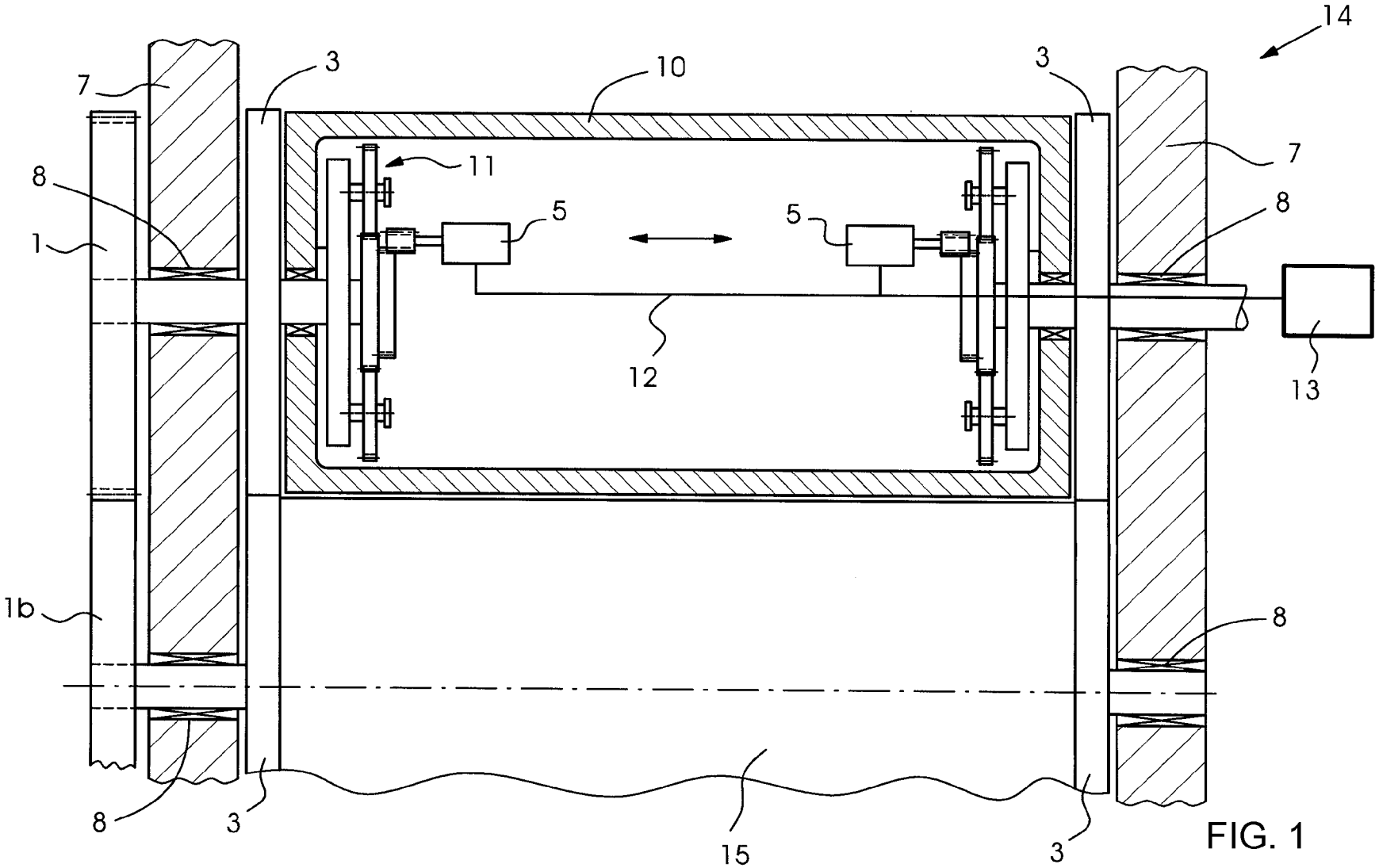
FIG. 1 is a fragmentary, diagrammatic, cross-sectional view of a plate cylinder having bearer rings actively rotatable through the use of an adjustment of epicyclic gear mechanisms.

Referring now to the figures of the drawings in detail and first, particularly, to FIG. 1 thereof, there is seen a portion of a printing unit of a printing press 14, which has a blanket cylinder 15 and a printing plate cylinder 10. During printing operation, the plate cylinder 10 carries a printing plate to which ink is applied by a non-illustrated inking unit. A printing image is transferred from the plate cylinder 10 to the blanket cylinder 15 and then applied to a printing material. Both the blanket cylinder 15 and the plate cylinder 10 each have respective bearer rings (Schmitz rings) 3 on both sides, which ensure a constant distance between plate cylinder 10 and blanket cylinder 15 and damp channel impacts. While the bearer rings 3 are firmly connected to the blanket cylinder 15, the plate cylinder 10 is rotatably mounted with respect to the bearer rings 3. This ability to rotate is implemented through two high step-up ratio epicyclic gear mechanisms 11, which are located in the interior of the plate cylinder 10. In order to adjust the plate cylinder 10 with respect to the bearer rings 3, the epicyclic gear mechanisms are each actuated by a respective setting device in the form of an electric adjusting drive or motor 5. The two adjusting motors 5 are connected through an electric connection 12 to a drive control system 13 placed outside the printing press. This drive control system 13 can be a constituent part of a machine computer of the printing press 14 and can monitor all of the drive units of the printing press 14. Transmission of the electric energy and electric control signals into the interior of the plate cylinder 10 can be carried out through a non-illustrated rotary transformer or through wireless radio transmission. The bearer rings 3 and therefore the entire plate cylinder 10 are mounted in a side wall 7 of the printing press 14 on both sides in a cylinder mounting 8. On the left-hand side, which is the drive side, the plate cylinder 10 is provided with a drive gear wheel 1, which is in engagement with further gear wheels 1*b* of the printing press 14. The blanket cylinder 15 also has a gear wheel 1*b*, so that the plate cylinder 10 and the blanket cylinder 15 are permanently coupled mechanically to each other. The blanket cylinder 15 is also rotatably mounted in the side walls 7 of the printing press 14 on both sides in a cylinder bearing 8. The plate cylinder 10 and the blanket cylinder 15 are thus permanently coupled mechanically through the gear wheels 1, 1*b*, so that accurate-register printing is ensured.

If a printing length correction in the circumferential direction is necessary, then appropriate setting commands are sent to the adjusting motors 5 from the electronic drive control system 13 in order to perform the corresponding printing length correction. The positions attained by the adjusting motors 5 can in turn be reported back to the drive control system 13, in order to close a control loop for desired/actual value control. Thus, the plate cylinder 10 is rotated precisely by the desired angle with respect to its associated bearer rings 3.

Figure 2:
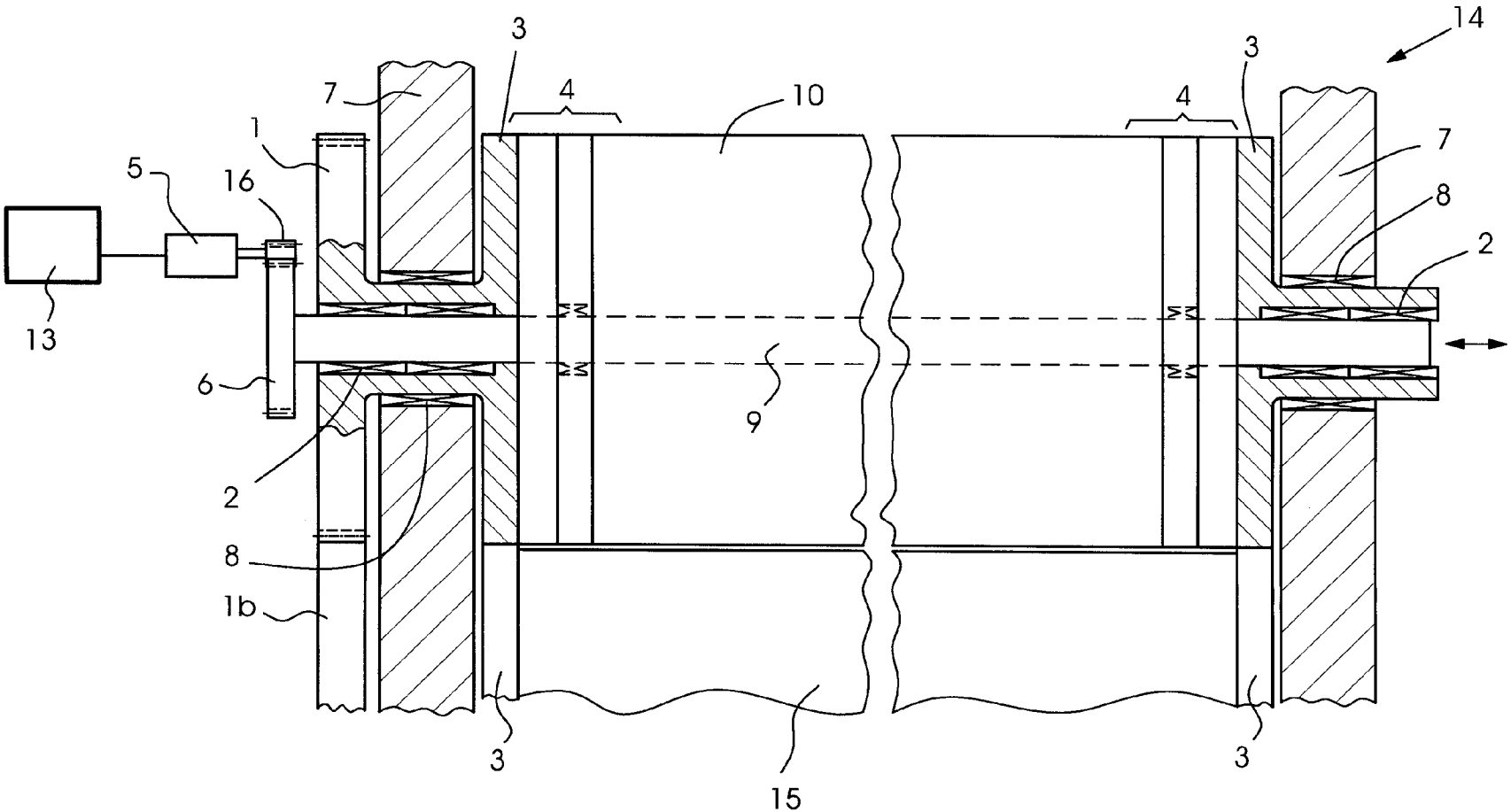
FIG. 2 is a fragmentary, cross-sectional view of a plate cylinder having bearer rings actively rotatable through the use of harmonic drive mechanisms.

A second embodiment of the invention is depicted in FIG. 2. Instead of the epicyclic gear mechanism 11 in FIG. 1, in this case it is possible to use what are known as harmonic drive mechanisms 4, which are described in more detail with respect to FIGS. 3A-3C. Through the use of the harmonic drive mechanisms 4, the bearer rings 3 of the plate cylinder 10 in FIG. 2 can likewise be rotated actively as desired with respect to the latter. In this case too, the bearer rings 3 of the plate cylinder 10 roll on the bearer rings 3 of a blanket cylinder 15. The two cylinders are likewise coupled mechanically to each other through a gear train including the gear wheels 1, 1*b*. At least on the drive side, which is the left-hand side, of the printing press 14, a further bearing 2 for an adjusting shaft 9 for the harmonic drive mechanism 4 is provided in the cylinder mounting 8. This adjusting shaft 9 actuates both harmonic drive mechanisms 4 simultaneously and is connected to an adjusting gear wheel 6 on the other side of the side walls 7. This configuration has the advantage that the adjusting motor 5 is not disposed within the plate cylinder 10 but can be mounted on the outside, fixed to the frame on the side wall 7 of the printing press 14. The adjusting motor 5 drives the adjusting gear wheel 6 of the adjusting shaft 9 through a drive pinion 16. In this way, the motor 5 adjusts both of the harmonic drive mechanisms 4 simultaneously through the common shaft 9. In this case too, the adjusting drive 5 is driven through an electronic control system 13. However, the adjusting motor 5 has to be constructed only for a low output but a high rotational speed. By contrast, the drive output for the plate cylinder 10 is transmitted through the gear train 1, 1*b*. In order to ensure that, with the printing press 14 rotating at a constant rotational speed, the angle between the bearer rings 3 and the plate cylinder 10 remains unchanged, the adjusting drive 5 must co-rotate synchronously at the rotational speed of the machine. The necessary rotational speed results from the respective transmission ratios of the gear mechanisms. By superimposing a differential speed on the adjusting drive 5, it is possible to move the desired adjustment angle between the bearer rings 3 and the plate cylinder 10 as desired and then keep it constant. In this case, the adjusting drive 5 is driven in such a way that synchronous operation is ensured at the leading edge of the printing plate on the plate cylinder 10. Over the entire circumferential length, an angle-dependent differential speed is applied to the adjusting drive 5. This differential speed can be stored in a movement profile in the electronic control system 13. However, this movement profile can also be calculated currently in each case as a function of the desired machine speed and of the desired rotational angle and then forwarded to the adjusting drive 5. Consequently, the rotational speed of the adjusting motor 5 is composed of a plurality of components, firstly of a synchronous component which depends on the machine speed and secondly of an offset component dependent on the respective rotational angle. As a result of the characteristics of the harmonic drive mechanism 4, the coupling between the bearer ring 3 and the plate cylinder 10 is rigid and torsionally stiff with respect to the gear train 1, 1*b*. The adjusting motor 5 has to apply only a relatively low torque in order to keep the rotational angle in the desired position.

An adjustment is not carried out through the bearer ring 3 of the plate cylinder 10 against the bearer ring 3 of the blanket cylinder 15, which would require higher torques in the case of non-lubricated bearer rings 3 and over a period would lead to damage. Instead, only the body of the plate cylinder 10 is rotated with respect to the blanket cylinder 15. However, the pressure between the body of the plate cylinder 10 and the blanket cylinder 15 is many times lower than the pressure between the bearer rings 3. As a result, it is possible to cover adjustment distances with the aid of the adjusting motor 5 and a corresponding step-down ratio. In order to achieve uniform adjustment of the rotatable cylinder 10, the harmonic drive mechanisms 4 are incorporated on both sides. The continuous shaft 9 is constructed in such a way that torsions are avoided. However, it is also possible for the two harmonic drive mechanisms 4 to each be driven by an adjusting motor 5, with purely electric coupling of the harmonic drive mechanisms 4 then being carried out, as in FIG. 1.

Figure 3A:
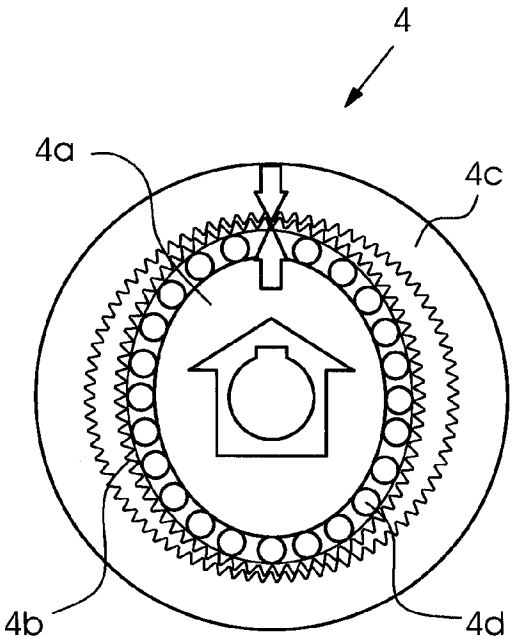
FIGS. 3A, 3B and 3C are side-elevational views showing a basic structure of a harmonic drive mechanism.
Figure 3B:
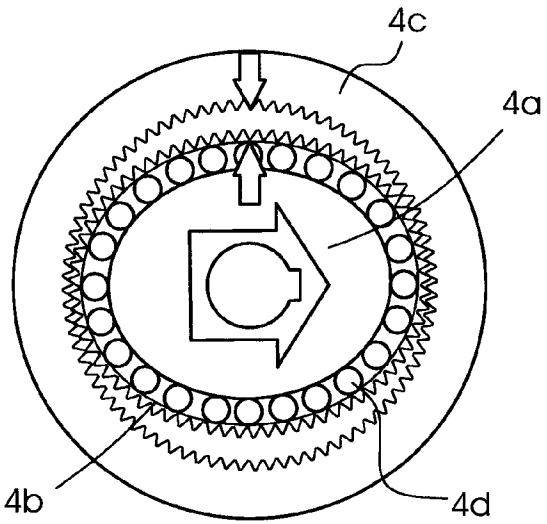
Figure 3C:
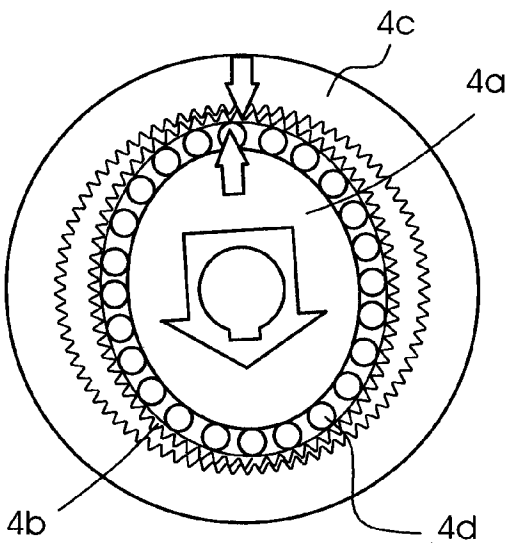

FIGS. 3A, 3B and 3C show the structure of a harmonic drive mechanism 4 in various positions, which will be described below. A harmonic drive mechanism 4 includes only a few components, which is the basic advantage as compared with an epicyclic gear mechanism 11. In principle, only three components are needed, a wave generator 4*a*, an internal spline gear 4*c* and a flexible spline gear 4*b*. The wave generator 4*a* is an elliptically shaped component and is driven by the adjusting motor 5. Through the use of ball bearings 4*d*, the wave generator 4*a* is able to influence the shape of the flexible spline gear 4*b*, which is formed as an external spline gear and in turn rolls on the internal spline gear 4*c*. The flexible spline gear 4*b* and the internal spline gear 4*c* are in engagement in opposite regions of the major elliptical axis. As a result of rotation of the wave generator 4*a*, the major elliptical axis and therefore the tooth engagement region are displaced. However, the flexible spline gear 4*b* has two fewer teeth than the internal spline gear 4*c*, so that after one half of a revolution, the wave generator 4*a* completes a relative movement of the magnitude of one tooth between the flexible spline gear 4*b* and the internal spline gear 4*c*. After one complete revolution, there is a relative movement of the magnitude of two teeth. Due to the large tooth engagement region, a high torque capacity is available, which is comparable with conventional drive devices having twice the overall space and three times the weight. Furthermore, the harmonic drive mechanism 4 exhibits high positioning accuracy. Due to the prestress induced by the function and of the radial tooth movement, this structure of the mechanism has as good as no play in the toothing system. In addition to a high efficiency of up to 85%, in the case of a very low step-up ratio, the harmonic drive mechanism 4 is distinguished by very low tooth wear. This is of great advantage during highly loaded, long employment in a printing press 14 and ensures the rotationally stiff, quasi rigid connection of the plate cylinder 10 to the gear train 1, 1*b* over the entire lifetime of the machine.

The invention claimed is:

1. A printing press, comprising:

bearer rings;

rotatably mounted cylinders including at least two adjacent cylinders rolling on one another by way of respectively associated said bearer rings; and a setting device for actively rotating at least one of said adjacent cylinders relative to an associated said bearer ring.

2. The printing press according to claim 1, which further comprises a mechanical coupling for coupling said adjacent cylinders to one another, said at least one cylinder being actively rotatable relative to said mechanical coupling.

3. The printing press according to claim 1, wherein said mechanical coupling is a gear mechanism or gear wheel.

4. The printing press according to claim 1, wherein said adjacent cylinders are a plate cylinder and a blanket cylinder of a printing unit.

5. The printing press according to claim 1, wherein one of said adjacent cylinders is a plate cylinder being actively rotatable relative to at least one of said bearer rings associated therewith.

6. The printing press according to claim 1, which further comprises a phase adjustment mechanism for actively rotating said at least one cylinder relative to at least one of said bearer rings associated therewith.

7. The printing press according to claim 6, wherein said phase adjustment mechanism is an epicyclic gear mechanism.

8. The printing press according to claim 6, wherein said phase adjustment mechanism functions on a principle of a harmonic drive mechanism.

9. The printing press according to claim 6, wherein said setting device is an adjusting drive for setting a rotational angle between at least one of said bearer rings and said at least one cylinder associated therewith through said phase adjustment mechanism.

10. The printing press according to claim 9, wherein said adjusting drive for said phase adjustment mechanism is located outside said at least one cylinder.

11. The printing press according to claim 9, wherein said adjusting drive for said phase adjustment mechanism is located inside said at least one cylinder.

12. The printing press according to claim 1, wherein said setting device is one of at least two electric adjusting drives being coupled electrically for actuating said at least one cylinder relative to said bearer rings.

13. The printing press according to claim 6, wherein said setting device is a common adjusting drive, and said mechanisms for said bearer rings of said at least one cylinder asso ciated therewith are coupled mechanically to one another and actuated by said common adjusting drive.

14. The printing press according to claim 1, wherein said setting device is at least one adjusting drive, and an electronic control device is connected to said at least one adjusting drive and contains previously stored or calculates control curves for actuation of said adjusting drive.

* * * * *